United States Patent [19]

Lordahl et al.

[11] 4,383,607

[45] May 17, 1983

[54] CLEAR PLASTIC DISPLAY BOX

[76] Inventors: Var E. Lordahl, 5847 S. Halsted St., Chicago, Ill. 60621; Robert G. Bedrosian, 2103 Adams St., Rolling Meadows, Ill. 60008

[21] Appl. No.: 334,517

[22] Filed: Dec. 28, 1981

[51] Int. Cl.[3] ..... B65D 75/20

[52] U.S. Cl. ..... 206/45.34; 206/470

[58] Field of Search ..... 206/45.34, 45.28, 44, 206/44 B, 449, 459, 461, 469, 470, 477, 480, 484, 488, 495; 229/2.5

[56] References Cited

U.S. PATENT DOCUMENTS

| | | | |
|---|---|---|---|
| 3,172,768 | 3/1965 | Joosten et al. | 206/45.34 |
| 3,229,810 | 1/1966 | Goller et al. | 206/45.34 |
| 3,498,018 | 3/1970 | Seiferth et al. | 206/484 |
| 3,645,384 | 2/1972 | Wind | 206/45.34 |
| 3,810,324 | 5/1974 | Hart | 40/158 R |
| 4,058,212 | 11/1977 | Wyslotsky | 206/470 |

FOREIGN PATENT DOCUMENTS

| | | | |
|---|---|---|---|
| 18252 | of 1909 | United Kingdom | 206/459 |

*Primary Examiner*—George E. Lowrance
*Assistant Examiner*—Jimmy G. Foster
*Attorney, Agent, or Firm*—W. A. Snow

[57] ABSTRACT

A one-piece, relatively rigid, thin, clear plastic box having a portion extending above the box in which to place an advertising card, a deeper portion to place articles of merchandise and a cover for the deeper portion positioned medially between the two to retain the articles in the deeper section.

1 Claim, 5 Drawing Figures

FIG-1
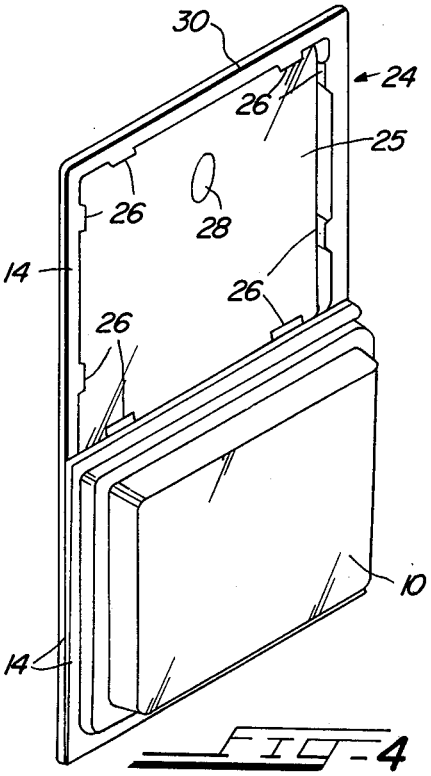
FIG-3
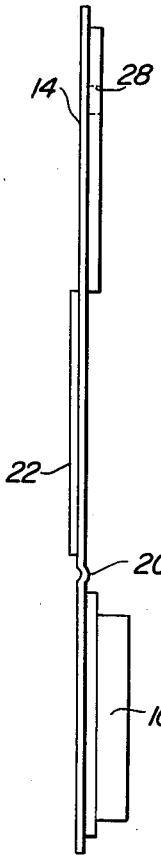
FIG-2
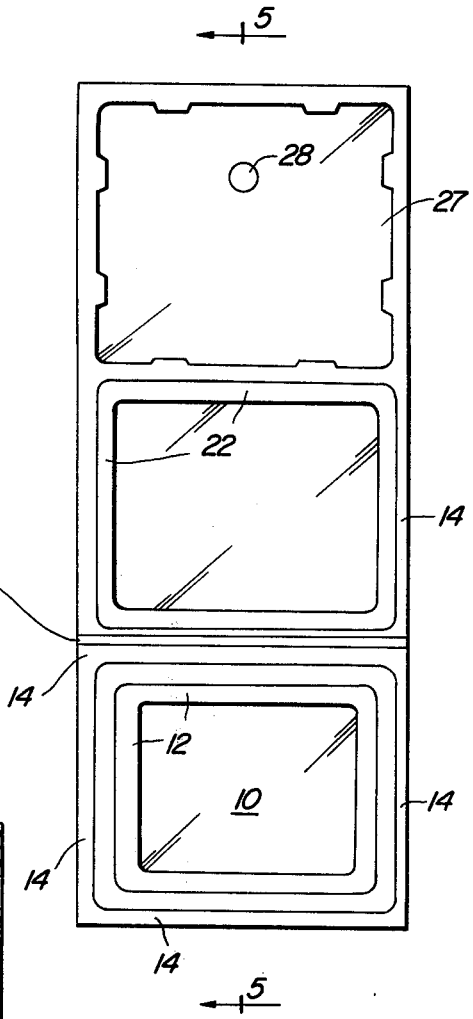
FIG-4
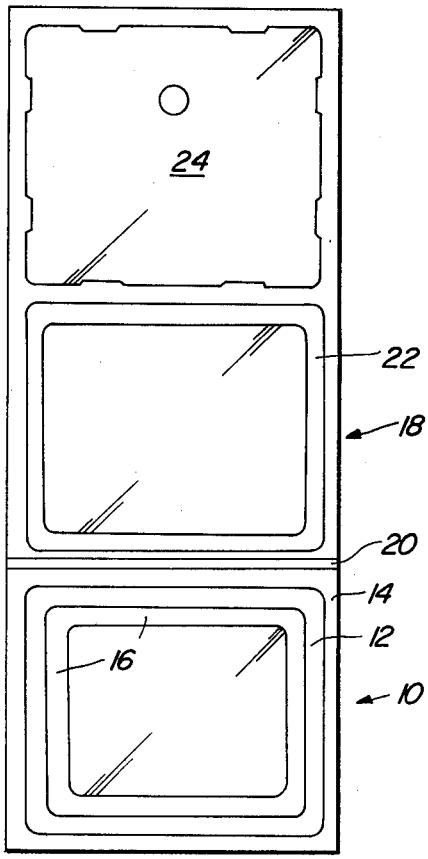
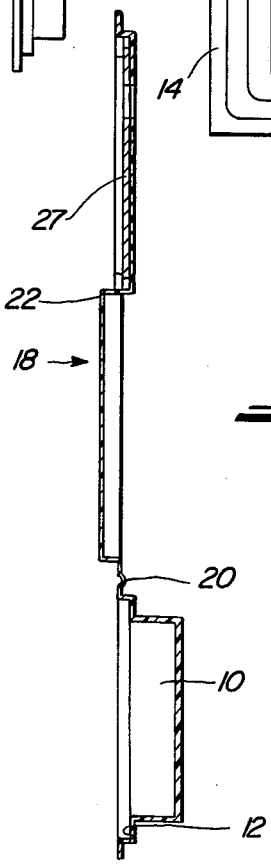
FIG-5

CLEAR PLASTIC DISPLAY BOX

SUMMARY OF THE INVENTION

A one-piece, relatively rigid, thin, clear plastic box for displaying physical articles in the lower or bottom section, a cover in the middle section integral with one edge of the lower section for placement on the end section with a plastic hinge therebetween, and a top section integral at one end with the middle section for containing a printed card to note the contents and other advertising features, said top section provided with detents to support the card and both containing a common aperture adjacent the upper medial portion for hanging on a pegboard display.

BRIEF DESCRIPTION OF THE DRAWINGS

FIG. 1 is a perspective view of the device of the present invention in closed position;

FIG. 2 is an elevational view in open position;

FIG. 3 is a side view in open position;

FIG. 4 is a bottom plan view thereof; and

FIG. 5 is a vertical cross-sectional view in open position.

DETAILED DESCRIPTION OF THE DRAWINGS

The device of the present invention is a one-piece, relatively rigid, thin, clear plastic display box comprising a lower or bottom section 10 having a depth forming an area to contain articles of merchandise and a peripheral recess 12 positioned around the upper surface of the bottom section to form a seat. The lower surface of the bottom section 10 is provided with a stiffening area 16 in the lower portions thereof as the plastic is relatively thin.

The medial or central section 18 forms a cover for the bottom section 10 and is connected together by a plastic hinge 20. The cover 18 is provided with an upwardly-extending peripheral rib 22 adjacent its outer edges for seating in the recess 12 of the bottom section 10 by friction to retain the physical articles in the bottom section 10 when the cover 18 is bent 180° about the hinge 20 and snapped into the recess 12.

The uppermost section 24 is indented as at 25 and contains a series of opposed, inwardly-extending detents 26 to support a card 27 therein which may contain data as to the contents of the box or instructions as to how to use the contents and/or other advertising matter. An aperture 28 is provided medially of the sides of the top section 24 and card 27 and below the upper end 30 thereof.

Since the entire structure is molded in one piece, the middle section 22 and the upper section 24 and the lower section 10 will be relatively stiff. A flange 14 will extend completely around the entire structure.

As seen in FIG. 3 of the drawings, the flange 14 extends in a straight line while the box 10 extends therebelow, the cover 18 extends thereabove and the top section 24 extends therebelow but about one-half as much as the box 10, and has the same depth as the cover 24.

The overall width of all of the sections is approximately 3 1/16 inches, as seen in FIG. 2, and the overall length in open position, as shown in FIGS. 3, 4 and 5, is approximately 7 11/16 inches. With the cover on the box, the overall length is about 5 inches.

However, the depth of the box may be larger and its overall length may also be larger.

The structure may be hung on a hook on a pegboard or the like by the aperture 24. An advantage lies in the fact that the entire structure may be used time and time again if only part of the contents are used by the purchaser. It supplants the blister package because once it is opened, it cannot be reclosed.

Although but one specific embodiment of this invention is herein shown and described, it will be understood that details of the construction shown may be altered or omitted without departing from the spirit of the invention as defined by the following claims.

We claim:

1. A substantially rigid one-piece clear plastic display box comprising:

(a) a lower section medially depressed to receive and display articles of merchandise, an outwardly extending flange on upper margins of said depression, and a peripheral recess in said flange;

(b) a middle section recessed medially upwardly and having an outwardly extending flange at the lower end of said recess, a peripheral rib in said flange adjacent its edges for seating in said recess in said lower section to cover the articles of merchandise and retain them in said lower section, a plastic hinge positioned between said lower and medial sections; and (c) an upper section medially depressed, an outwardly extending flange on the upper margin of said depression having a series of tabs extending inwardly of said flange and over said depression for supporting a card containing printed matter thereon.

* * * * *